United States Patent [19]

Stalson et al.

[11] 4,394,786

[45] Jul. 26, 1983

[54] APPARATUS FOR CLEANING AND SCALE DUST REMOVAL FROM STEEL ROD AFTER MECHANICAL DESCALING

[75] Inventors: Stanley L. Stalson, Richfield; William H. Johns, Stow, both of Ohio

[73] Assignee: Wire Lab Company, Richfield, Ohio

[21] Appl. No.: 356,482

[22] Filed: Mar. 9, 1982

Related U.S. Application Data

[63] Continuation-in-part of Ser. No. 152,354, May 22, 1980, abandoned.

[51] Int. Cl.[3] ..... A47L 5/38

[52] U.S. Cl. ..... 15/306 A; 15/347; 72/39; 134/21

[58] Field of Search ..... 15/302, 306 A, 316 R, 15/306 B, 306 R, 347; 134/9, 15, 21, 64 R, 122 R; 204/208; 72/39

[56] References Cited

U.S. PATENT DOCUMENTS

| | | | |
|---|---|---|---|
| 3,044,098 | 7/1962 | Stalson | 15/302 |
| 3,496,086 | 2/1970 | Stalson et al. | 204/208 |
| 3,595,045 | 7/1971 | Fuqua | 72/39 |
| 3,736,618 | 6/1973 | Ramsey | 15/306 A |
| 3,775,806 | 12/1973 | Olbrant | 15/306 A |
| 3,806,366 | 4/1974 | Cofer | 134/15 |
| 4,033,785 | 7/1977 | Gibbs | 134/15 |
| 4,296,556 | 10/1981 | Bray | 15/306 R |

OTHER PUBLICATIONS

"An Overview of Mechanical Descaling", by Stanley L. Stalson, pp. 63–90, May 19, 1977.

"Steel Wire Handbook", vol. 1, Chapter 3, pp. 93–229, Cleaning and Coating in Preparation for Drawing, 1965.

*Primary Examiner*—Billy J. Wilhite

*Attorney, Agent, or Firm*—Fay & Sharpe

[57] ABSTRACT

An apparatus for continuously removing fine scale dust comprising oxides of iron, such as FeO, $Fe_2O_3$, and $Fe_3O_4$ from mechanically descaled hot-rolled or heat-treated steel strand as preparation for wire drawing.

Generally hot-rolled or heat-treated steel wire strand must be descaled prior to cold drawing into wire products. When mechanically descaled, as by reverse bending, large pieces of brittle scale separate readily from the steel surface but smaller dust-like particles remain attached to the surface as by electromagnetic or electrostatic forces. These small particles must be removed prior to cold drawing into wire; otherwise, drawing die life is seriously reduced by the abrasive nature of the fine scale dust particles.

The invention herein comprises an apparatus for the continuous removal of iron oxide scale dust from mechanically descaled steel strand. The invented apparatus is intended for use in tandem with mechanical descaling equipment. Both pieces of equipment operate continuously and in-line with the wire drawing equipment in preparing the steel strand for processing into wire.

The invention herein is designed to remove fine scale dust from mechanically descaled strands using compressed air only. The compressed air is made to form equal, opposing high velocity jets that perform the cleaning. The design also causes containment of the removed scale dust and prevents escape to the atmosphere.

5 Claims, 2 Drawing Figures

APPARATUS FOR CLEANING AND SCALE DUST REMOVAL FROM STEEL ROD AFTER MECHANICAL DESCALING

This application is a continuation-in-part of application Ser. No. 152,354, filed May 22, 1980, now abandoned.

BACKGROUND OF THE INVENTION

To produce a steel wire strand, steel billets are heated to red heat or higher and hot rolled in a rod mill. The elevated temperature of the processing causes the formation of iron oxides on the surface of the hot-rolled rod (designated herein as "strand"). These iron oxides, such as FeO, $Fe_2O_3$, and $Fe_3O_4$ are known as mill scale. Elevated temperature heat-treating of steel strand may also cause such scale to form.

Mill scale levels vary depending on the type of rod rolling mill used, the level of elevated temperature reached, and the time at elevated temperature. Traditional rod mills will produce rod with approximately one (1) percent by weight of mill scale. In a newer process for rod production, the hot-rolled rod is control-cooled thereby reducing mill scale levels to approximately 0.25 to 0.50 percent by weight. During the transit and storage of steel rod additional iron oxides form, commonly known as rust.

For the successful production of steel wire or strand from hot-rolled or heat-treated steel rod, the iron oxides on the rod must first be removed essentially in their entirety.

Iron oxide scale removal from hot-rolled or heat-treated steel rods can be accomplished using chemical or mechanical processing. Chemical processing includes such methods as acid pickling and molten salt bath immersion. Mechanical processing includes such methods as abrasive belting, shot blasting, and reverse bending. Reverse bend descaling is based on the fact that steel is ductile and mill scale is brittle. Controlled deformation of the steel rod therefore loosens and removes the brittle mill scale. One method of controlled deformation is reverse bending as by passing rod over a series of sheaves.

These scale removal methods are as described in Stalson U.S. Pat. Nos. 3,496,086 and Stalson 3,044,098 and the following publications:

Stalson, Stanley L., "An Overview of Mechanical Descaling," Joint Conference Proceedings, Ferrous Division/Pacific Coast Meeting, The Wire Association International, Inc., Guilford, Connecticut 06437, May 19, 1977, pps. 63–90

STEEL WIRE HANDBOOK, Vol. 1, The Wire Association Inc., Stamford, Connecticut, 1965, "Cleaning and Coating in Preparation for Drawing," Chapter 3, pps. 93–229

This invention relates to the removal of iron oxide scale dust that remains on steel rods and strands after descaling by mechanical processing methods. The scale dust is attached to the steel strand as by electromagnetic or elastrostatic forces. This abrasive residual iron oxide dust must be removed to maximize wire drawing die life and productivity. To clean steel rod in preparation for drawing, the rod is passed through the apparatus. The apparatus removes residual dust by breaking the forces attaching the dust to the steel strand using equal, opposing high-velocity multiple air jets situated at each end of the apparatus. The apparatus is further designed to contain and to collect the removed dust thereby preventing dispersion into the atmosphere. The apparatus also continuously processes the dust-laden air, separating the scale dust and returning only clean air to the atmosphere.

SUMMARY OF THE INVENTION

The present apparatus is a cleaner for the continuous removal and containment of residual scale dust from mechanically descaled steel strand that is to be drawn into wire. In typical use the cleaning apparatus operates in-line with the processing equipment cleaning mechanically descaled strand continuously prior to the strand entering the wire drawing equipment. The apparatus accomplishes the cleaning using compressed air only. The design of the apparatus is such as to cause the formation of high velocity air jets which perform the cleaning function. The high velocity air jets are further designed to create a strong inward air flow from each end of the apparatus into the center of the apparatus thereby sealing the strand entry and exit ports of the apparatus against scale dust escape. The design further causes the exhaust of the scale-air mixture into a suitable scale dust filter and containment device from which only clean air is returned to the atmosphere.

In this invention, compressed air flows through two identical tubular-type nozzles situated at each end of the apparatus passing first through multiple radial orifices situated in said nozzles. The radial orifices have a converging conical angular relation to the axis of the tubular-type nozzle. The direction of convergence is away from each end port and toward the center chamber of the apparatus. The air flow from a manifold and through the orifices creates high velocity air jets. The moving mechanically descaled strand enters the apparatus through an end port, passes through the axial centerline of the tubular-type nozzles and exits through an end port. The high-velocity converging conical air jet streams created by the orifices in the nozzles encircle, converge and impinge upon the surface of the moving strand thereby continuously removing the scale dust therefrom. The apparatus design also causes containment of the scale dust-laden air preventing dispersion to the atmosphere. The high velocity air jets create a Venturi effect which inducts outside air into the apparatus through the end ports. The strong inward air flow thus created prevents outward flow of the air-dust mixture from the end ports. The apparatus is further designed to collect and to separate, as by filtering, the scale dust from the dust-laden air, exhausting only clean, dust-free air to the surrounding area.

BRIEF DESCRIPTION OF THE DRAWINGS

The preferred embodiment of this invention is described in detail in this specification and illustrated in the accompanying drawings which form a part hereof, wherein.

DESCRIPTION OF THE PREFERRED EMBODIMENT

After mechanically descaled, the strands as taught in the prior art, have lost most of the hot-rolled mill scale. Mechanical descaling using reverse bending mechanically breaks the brittle scale from the strand surface by a combination of bending and stretching while the strand is being pulled over a set of sheaves by the wire drawing machine. Although the bulk quantity of scale is removed by the mechanical descaling process, scale dust particles remain on the surface of the strand attached as by electromagnetic or electrostatic forces. Removing the residual scale dust has been previously attempted or accomplished using such apparatus as brushes, abrasive material such as steel wool in a box, and washing and drying. This invention accomplishes the necessary scale dust removal using only controlled, high-velocity air jets. The new apparatus which is the subject of this invention is the air jet cleaner shown in FIG. 1. The cleaner removes and contains loose scale dust that clings to the surface of the rods after mechanical descaling.

The air jet cleaner effectively removes loose fine dust scale particles from all types of mechanically descaled steel rods. In a typical operation, strands such as rods or wire are cleaned at payoff speeds up to 850 fpm (4.3 meters/sec.). Low-to-high carbon steels may be cleaned along with most alloy grades.

Upon exiting from the air jet cleaner, the strand passes through a lubricant box and drawing die, which are of conventional design, and is pulled through the foregoing steps by a wire drawing machine.

Figure 1:
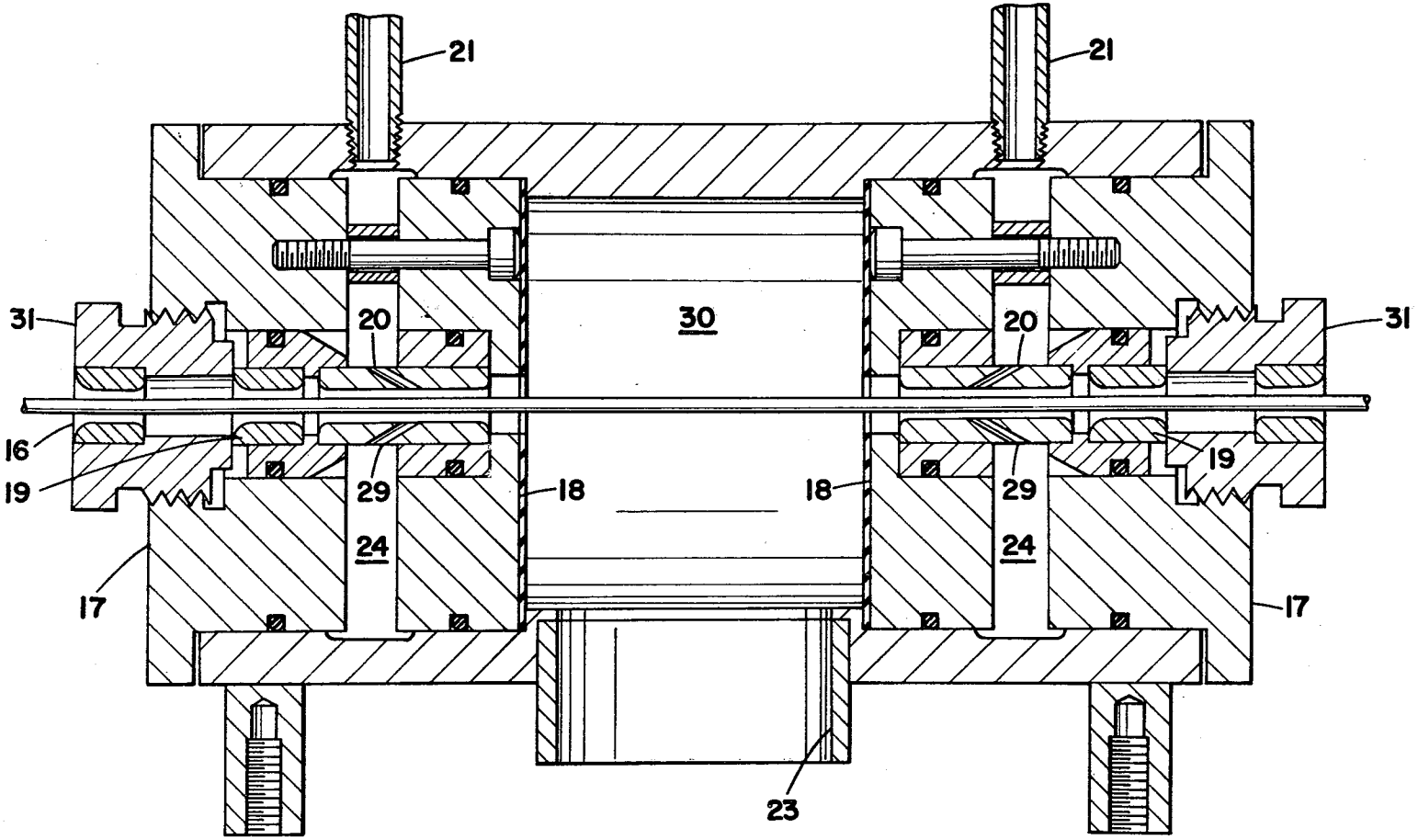
FIG. 1 is a cross-sectional view of the air jet cleaning apparatus.

FIG. 1 is a cross-sectional view of the air jet cleaner. Strands enter the cleaner at 16 and move from left to right. At the entrance and exit ends are plugs 17 and 18, shown spaced apart and forming high pressure manifolds 24. Fitted in each end and spanning the space between plugs 17 and 18 are identical tubular-type nozzles 20 held firmly in place by nozzle holders 31. At one end of each nozzle 20 are guide bushings 19. The opening in the guide bushing 19 is smaller than the central axial opening in the nozzle 20 so as to guide the strand and to keep the strand from rubbing the inside of the nozzles 20. The nozzles 20 have multiple radial air jet orifices 29. The multiple air jet orifices 29 are at an angle of 10 to 50 degrees (preferably 30 degrees) relative to the central axis of the nozzles 20 in a converging conical relationship and are directed inward with respect to each end of the apparatus and toward the central chamber 30. At the bottom of central chamber 30 is an exhaust port 23.

In operation a common compressed air source at a pressure of 60 to 150 psi (nominally 90 psi) enters at inlets 21 and creates high pressure in the manifolds 24 formed by plugs 17 and 18. The high pressure air flows from the manifolds 24 through the multiple orifices 29 in the nozzles 20 situated at each end of the apparatus thereby creating high-velocity air jets inside the nozzles 20. The high-velocity air jets encircle, converge on and impinge the moving steel strand thereby removing the attached scale dust. The high-velocity air jets having an angular relation to the central axis of the nozzles 20 and being directed toward the center chamber 30 of the apparatus cause the dust-air mixture to flow into the center chamber 30. The high-velocity air jets further create a Venturi effect that augments the total air flow by causing the induction of outside air into the air jet cleaner at each end port 16. This further prevents the escape of dust-laden air from the end ports 16 of the apparatus. The use of identical opposing air nozzles 20 causes the now dust-laden air to flow with equal velocity and quantity into the central chamber 30 of the apparatus. Neither air stream can overcome the other thereby further assuring containment of the dust-air mixture within the apparatus. The design further causes the flow of the dust-laden air to be exhausted from the central chamber 30 only through the bottom exhaust port 23 of the apparatus and then into a suitable dust filtering and containment device, shown in FIG. 2. Only clean air is returned to the work area.

Figure 2:
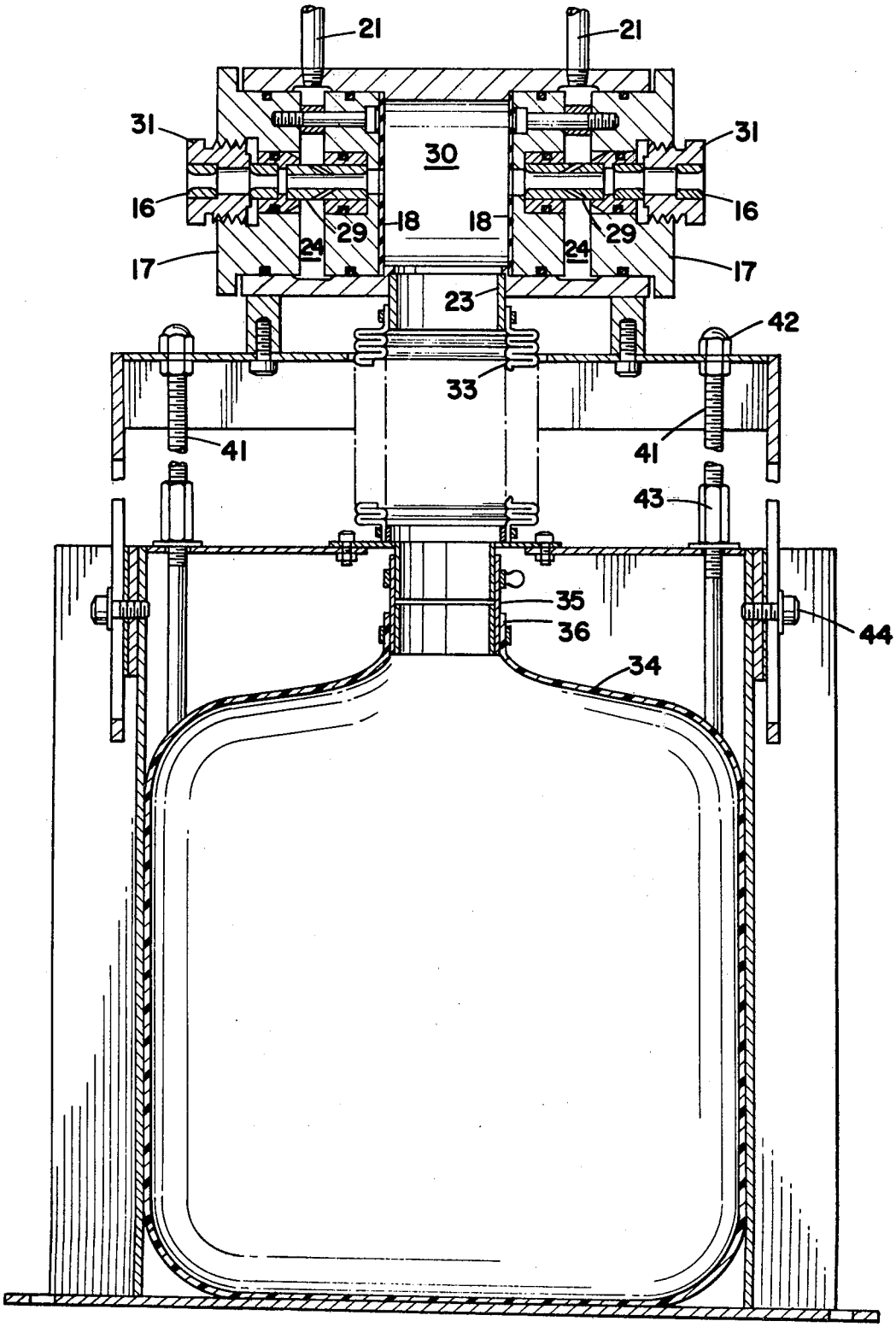
FIG. 2 is a cross-sectional view of the air jet cleaning and dust collecting containment device.

FIG. 2 is a cross-sectional view of the entire air jet cleaning and dust collecting containment device. The air jet cleaning features are highlighted in FIG. 1. FIG. 2 shows the exhaust port 23 which is secured to bellows 33 and, in turn, is connected to the dust collecting container 34. The connection is made through opening 35 in the container 34 by means of quick-release fastening clamps, such as shown at 36. Air is exhausted through openings in the fabric of container 34, which is capable of containing submicron size particles.

On top of the containment vessel are vertical adjustment screws 41 with cap screws 42 attached to the top portion and a vertical adjustment nut 43 which allow the air jet cleaner to be moved vertically to line up the cleaner with the pass line of the wire or strand in the wire drawing line.

Similar adjustments, not shown herein, provide lateral adjustment. The bellows accomodates the adjustment. Slide fastener 44 on the side permits the vertical adjustments. Quick-release clamp 36 is of the Voss type allowing secure clamping and quick release for ready replacement. The filter bags are reusable.

Although the invention has been shown and described with respect to preferred and alternative embodiments, modifications and alterations will occur to others upon a reading and understanding of this specification. The present invention includes all such modifications and alterations insofar as they come within the scope of the appended claims or the equivalents thereof.

What is claimed is:

1. A waterless particle removing apparatus for removing scale particles from a carbon steel strand, the apparatus comprising:

a housing which defines an entrance opening, an exit opening, and a central chamber disposed in alignment along a central axis such that the strand is adapted to be moved linearly along the central axis through the entrance opening, the central chamber, and the exit opening;

a compressed air manifold for supplying air under pressure;

a tubular entrance nozzle having an entrance nozzle passage and a plurality of entrance air jet orifices, the entrance nozzle being disposed in the entrance opening with the entrance nozzle passage in alignment with the central axis, the entrance air jet orifices being disposed in fluid communication between the air manifold and the nozzle passage and being directed toward the central chamber in such a manner that a venturi effect is created drawing air from exterior of the housing, through the entrance nozzle passage where it mixes with scale particles freed from the steel strand, and into the central chamber, whereby the venturi effect prevents scale particles from escaping through the entrance nozzle passage to the exterior of the housing;

a tubular exit nozzle having an exit nozzle passage and a plurality of exit air jet orifices, the exit nozzle being disposed in the exit opening with the exit nozzle passage in alignment with the central axis, the exit air jet orifices being disposed in fluid communication between the air manifold and the exit nozzle passage and being directed toward the central chamber in such a manner that a venturi effect is created drawing air through the exit nozzle passage where it mixes with scale particles freed from the steel strand and into the central chamber, whereby the venturi effect prevents scale particles from escaping through the exit nozzle passage to the exterior of the housing; and, a scale particle filtering device operatively connected with the central chamber for allowing scale particle free air to be returned to the exterior of the housing and collecting scale particles therein.

2. The apparatus of claim 1 in which the air jet orifices are at 10°–50° with respect to the central axis.

3. The apparatus of claim 1 in which the air jet orifices are 30° with respect to the central axis.

4. An apparatus for waterless, air jet removal of particles from a wire, the apparatus comprising:

means for defining chamber, an entrance opening operatively connected with the chamber, and an exit opening operatively connected with the chamber, the chamber, the entrance opening, and the exit opening being disposed relative to each other such that the wire is adapted to be moved continuously through the entrance opening, the chamber, and the exit opening;

an entrance nozzle disposed in the entrance opening, the entrance nozzle having an entrance nozzle passage therethrough through which the wire is adapted to be moved and a plurality of air jet orifices directed toward the chamber in such a manner that a venturi effect is created, whereby the entrance air jet orifices prevent particles from escaping through the entrance nozzle passage;

an exit nozzle disposed in the exit opening, the exit nozzle having an exit nozzle passage therethrough through which the wire is adapted to be moved and a plurality of exit air jet orifices directed toward the chamber in such a manner that a venturi effect is created, whereby the exit air jet orifices prevent particles from escaping through the exit nozzle passage; and, means for removing particles from the chamber.

5. The apparatus of claim 4 wherein the particle removal means includes an opening for air and particles to flow to a dust collecting means.

* * * * *